US007278914B1

(12) United States Patent
Marks et al.

(10) Patent No.: US 7,278,914 B1
(45) Date of Patent: Oct. 9, 2007

(54) SYSTEM AND METHOD OF BETTING ON A SPORTING EVENT WHICH AWARDS PAY OUTS BASED ON THE DIFFERENCE BETWEEN THE ACTUAL AND PREDICTED RESULTS ("PAY PER POINT")

(76) Inventors: Daniel M. Marks, 152 Airport Executive Park, Nanuet, NY (US) 10954; Anthony M. Singer, 125 Burnt Meadow Rd., Ringwood, NJ (US) 07456; Howard M. Marks, 68 High Point Rd., Westport, CT (US) 06880

( * ) Notice: Subject to any disclaimer, the term of this patent is extended or adjusted under 35 U.S.C. 154(b) by 753 days.

(21) Appl. No.: 10/438,325

(22) Filed: May 15, 2003

Related U.S. Application Data

(63) Continuation-in-part of application No. 09/939,787, filed on Aug. 28, 2001, now Pat. No. 6,960,133, application No. 10/438,325, which is a continuation-in-part of application No. 10/105,942, filed on Mar. 26, 2002, now Pat. No. 6,935,947, which is a continuation-in-part of application No. 09/432,602, filed on Nov. 3, 1999, now abandoned, which is a continuation-in-part of application No. 09/234,098, filed on Jan. 19, 1999, now Pat. No. 6,371,851, which is a continuation of application No. PCT/US98/10373, filed on May 21, 1998, application No. 10/438,325, which is a continuation-in-part of application No. 09/613,727, filed on Jul. 11, 2000, now Pat. No. 6,604,998.

(60) Provisional application No. 60/228,472, filed on Aug. 28, 2000, provisional application No. 60/047,493, filed on May 23, 1997, provisional application No. 60/289,633, filed on May 9, 2001, provisional application No. 60/164,583, filed on Nov. 10, 1999, provisional application No. 60/380,485, filed on May 15, 2002, provisional application No. 60/412,012, filed on Sep. 20, 2002, provisional application No. 60/445,769, filed on Feb. 10, 2003.

(51) Int. Cl.
*A63F 9/24* (2006.01)
*A63F 1/00* (2006.01)

(52) U.S. Cl. ..... 463/16; 273/138.1

(58) Field of Classification Search ..... 273/138.1, 273/274, 139; 463/16, 20, 28
See application file for complete search history.

(56) References Cited

U.S. PATENT DOCUMENTS

| | | | | | |
|---|---|---|---|---|---|
| 5,573,244 | A * | 11/1996 | Mindes | ..... | 463/26 |
| 5,842,921 | A * | 12/1998 | Mindes et al. | ..... | 463/16 |
| 6,126,543 | A * | 10/2000 | Friedman | ..... | 463/16 |
| 6,500,066 | B1 * | 12/2002 | Bower et al. | ..... | 463/20 |
| 6,527,270 | B2 * | 3/2003 | Maksymec et al. | ..... | 273/138.1 |
| 6,910,965 | B2 * | 6/2005 | Downes | ..... | 463/28 |

* cited by examiner

*Primary Examiner*—Robert E Pezzuto

(57) ABSTRACT

A system and method for sports betting that awards pay outs based upon the difference between the actual and predicted results ("Pay Per Point"). In a preferred embodiment of the invention, the Pay Per Point bettor may place any or all of three different bets: 1) spread-line bet, 2) event-total-line bet, 3) team-total-line bet. For the spread-line bet, the bettor collects a pay out based upon the difference between the actual score and predicted spread-line. For the event-total-line Bet, the bettor collects a pay out based upon the difference between the actual score and predicted spread-line.

4 Claims, 6 Drawing Sheets

SYSTEM AND METHOD OF BETTING ON A SPORTING EVENT WHICH AWARDS PAY OUTS BASED ON THE DIFFERENCE BETWEEN THE ACTUAL AND PREDICTED RESULTS ("PAY PER POINT")

RELATED APPLICATIONS

This application is a continuation-in-part of U.S. application Ser. No. 09/939,787, filed Aug. 28, 2001 now U.S. Pat. No. 6,960,133, which claims priority from U.S. Provisional Application No. 60/228,472, filed Aug. 28, 2000. This application is also a continuation-in-part of U.S. application Ser. No. 10/105,942, filed Mar. 26, 2002 now U.S. Pat. No. 6,935,947, which is a continuation-in-part of U.S. application Ser. No. 09/432,602, filed Nov. 3, 1999 now abandoned, which is a continuation-in-part of U.S. application Ser. No. 09/234,098, filed Jan. 19, 1999, now U.S. Pat. No. 6,371,851, which is a continuation of International Application No. PCT/US98/10373, filed May 21, 1998, which in turn claims priority from U.S. Provisional Application No. 60/047,493, filed May 23, 1997. U.S. application Ser. No. 10/105,942 also claims priority from U.S. Provisional Application No. 60/289,633, filed on May 9, 2001. This application is also a continuation-in-part of U.S. application Ser. No. 09/613,727, filed Jul. 11, 2000 now U.S. Pat. No. 6,604,998, which claims priority from U.S. Provisional Application No. 60/164,583, filed Nov. 10, 1999. This application also claims priority from U.S. Provisional Application Nos. 60/380,485, filed May 15, 2002, 60/412,012, filed Sep. 20, 2002, and 60/445,769, filed Feb. 10, 2003. All of these applications are incorporated herein by reference.

BACKGROUND OF THE INVENTION

1. Field of Invention

The invention relates to a system and method for betting on sporting events. In particular, this invention awards pay outs based upon the difference between the actual and predicted results.

2. Background Description of Sports Betting

Sports bettors ("bettors") place sports bets ("bets") on a sports figure, sports team, or group of figures and/or teams ("contestants") at a legal sports betting location ("house" or "sports book"). In particular, sports betting operates in the following manner:

The House. The house offers bettors an impartial and unbiased betting environment in which to place their wagers. In return for providing such neutral brokering services, the house charges a fee ("vig" or "vigorish") on all bets or, in some cases, just winning bets.

To remain impartial and unbiased, the house avoids financial interest in the outcome of the sporting event by matching equal amounts on opposing contestants ("balancing the books"). With balanced books, the house pays the winning bets with the losing bets ("covering") and generates profits by collecting vigs. For example, the house accepts bets of $1,100,000 on Team A and $1,100,000 on Team B. By charging a 10% vig on all winning bets, the house will collect $2,200,000 and pay out $2.1 million, with a profit of $100,000 from vigs.

As often happens in sporting events, however, bettors favor one contestant ("favorite") over another ("underdog") and, as a result, a greater sum is bet on the favorite ("unbalanced books"). With unbalanced books, the house loses its neutrality, as follows:

If the house allows unbalanced books and the favorite wins, the losing bets placed on the underdog will not cover the bets placed on the favorite. The house will then have to pay winning bets out of its own funds.

If the house allows unbalanced books and the underdog wins, the losing bets placed on the favorite will more than cover the bets placed on the underdog. The house will then have made a profit beyond the vigs.

Imbalanced books strip the house of its neutrality and diminish its ability to attract and serve bettors; the more imbalanced the books, the more diminished the abilities. In addition, imbalanced books also introduce undesirable fluctuations in revenues and profit. The house, therefore, avoids these risks by balancing the bets made on opposing contestants.

The Bets. To equalize betting on the favorite and underdog, the house uses several types of bets, "Spread-Line" "Money-Line," and "Event-Total-Line." These bets provide the house with the flexibility to attract betting on either favorite or underdog and, therefore, preserve neutrality, as follows:

Spread-Line Bet: The spread-line bet pays for selecting the contestant that wins or loses by a predetermined amount ("spread-line"). The favorite must win the contest by more than the spread. The underdog must lose by less than the spread-line or win the contest.

For example, the house sets the spread-line as New York −7 (favorite) at Miami +7 (underdog). The bettor bets on New York, the favorite. If New York wins by more than 7 points, the bettor wins the bet. If New York wins by less than 7 or Miami wins, the bettor loses the bet. And, if New York wins by exactly 7 points, the bet is returned to the bettor ("no action").

The spread-line bet lets the house adjust the handicap to affect the likelihood of winning. If more betting is required on the underdog, the house increases the spread-line, and, therefore, makes it easier for the underdog to win. For example, adjusting the spread-line to New York −10 at Miami +10 would attract more wagers on Miami.

Money-Line Bet: The money-line bet pays for selecting the actual winning contestant, with different pay outs for selecting the favorite or the underdog ("money-line"). A winning bet on the favorite returns less than 100%; a winning bet on the underdog returns greater than 100%.

For example, the house sets the money-line on New York −150 (favorite) at Miami +135 (underdog). To bet on New York, the bettor must wager $150 to win $100 (i.e. 66.67% return). To bet on Miami, the bettor must wager $100 to win $135 (i.e. 135% return).

The money-line bet lets the house adjust the odds to affect the pay outs for winning. If more betting is required on the underdog, the house increases the money-line, and therefore, makes it more rewarding to bet on the underdog. For example, adjusting the money-line to New York −200 at Miami +175 would attract more wagers on Miami.

Event-Total-Line Bet: The event-total-line bet pays if the contestants exceed ("over") or fail to attain ("under") a pre-determined score ("event-total-line"). To win an over bet, the contestants must combine to score more than the event-total-line. To win an under bet, the contestants must combine to score less than the event-total-line. The winner of the contest is irrelevant.

For example, the house sets the event-total-line to 45 on the New York-Miami game. The bettor bets on over. If the teams combine to score more than 45 points, the bettor wins the bet. If the teams combine to score less than 45 points, the bettor loses the bet. And, if the teams combine to score exactly 45 points, the game is considered no action.

The event-total-line bet allows the house to adjust the even-total-line to affect the likelihood of achieving the desired score. If more betting is required on the under bet, the house raises the event-total-line, and therefore, makes it easier to win the under bet. For example, increasing the event-total-line to 50 on the New York-Miami game would attract more under wagers.

By adjusting the spread-line, money-line, or event-total-line, the house avoids unbalanced books. Adjustments, however, are not retroactive to all bets; the bet is fixed at the time it is placed. For example, a money-line bet placed on the favorite at +140 stays at +140, even if the house raises the money-line to +180 at a later point.

Limitations of Sports Betting

The mechanics of sports betting creates a system focused upon balancing the books by using spread-line, money-line, and event-total-line bets. These bets, however, only offer "all or nothing" payouts, without regard for the difference between the actual and predicted results, as follows:

Spread-line bets award fixed pay outs for selecting a winner. For example, a team winning by 1 point over the spread-line pays the same amount as the same team winning by 20 points.

Money-line bets award fixed pay outs for selecting a winner. For example, a team winning by 1 point pays the same amount as the same team winning by 20 points.

Event-total-line bets also award fixed pay outs for over or under bets. For example, teams scoring 1 point over the event-total-line pay the same amount as the same teams scoring 50 points over the event-total-line.

In addition, the bettor cannot place a bet on an individual contestant to score more or less than a predicted number of points. Instead, the bettor is limited to making an event-total-line bet that combines the score of all contestants.

As a result of these drawbacks, the house must offer current bettors limited pay outs and cannot attract new bettors with exciting awards. At the same time, the bettors suffer from a limited selection of bets that do not offer any additional awards based upon the actual results of the contest. Thus, there is a need for a new sports betting method which awards pay outs based upon the difference between the actual and predicted results.

SUMMARY OF THE INVENTION

It is an object of the invention to address the limitations associated with conventional sports betting by creating a new system and method for sports betting that awards pay outs based upon the difference between the actual and predicted results ("Pay Per Point").

In a preferred embodiment of the invention, the Pay Per Point concept operates as follows:

Pay Per Point Bets. The bettor may place any or all of the following three bets: 1) spread-line bet, 2) event-total-line bet, or 3) team-total-line.

The first two bets are standard spread-line and event-total-line bets, as described in the Background of Sports Betting section above. The last bet, team-total-line, is a new bet that allows the bettor to bet on the total score of an individual team. In particular, the team-total-line bet is established by using the spread-line and event-total-line, as follows:

The house sets the spread-line for Team A −4 ("S1") to beat Team B+4 ("S2"); the event-total-line at 30 ("E");

Team A's team-total-line is determined to be, (E−S1)/2=(30−(−4))/2=(30+4)/2=17; and Team B's team-total-line is determined to be, (E−S2)/2=(30−4)/2=13.

Using the new team-line-total bet, a bettor may place wagers on Team A to score over or under 17 points and Team B to score over or under 13 points. In addition, the bettor may also place traditional spread-line bets on Team A −4 or Team B +4 points or an event-total-line bet on Team A and Team B to score over or under 30 points.

Pay Per Point Pay Outs. For all bets, the bettor collects a fixed amount ("F") for each point of difference ("D") between the actual ("A") and predicted ("P") results, or D=A−P and F*D=Pay Out. The greater the value of D, the larger the pay out.

For example, the bettor places a team-total-line bet of $110 on Team A to score over 17 points and collects $26 for each point that Team A exceeds 17. If Team A actually scores 21 points, then F=26 and D=21−17 and bettor collects $104, or $26 (F)*4(D). Alternatively, if Team A actually scores 45 points, the bettor collects $728, or $26 (F)*28(D). (For more details on calculating the value of F refer to Pay Schedules for Pay Per Point Bets section below.)

Thus, the preferred embodiment offers an exciting method of awarding pay outs for the traditional spread-line and event-total-line bets, and the new team-total-line bets.

BRIEF DESCRIPTION OF THE DRAWINGS

The following figures will help the reader understand the invention, including the detailed description of the preferred embodiment described below.

The same reference numbers refer to the same parts throughout the various figures.

DETAILED DESCRIPTION OF A PREFERRED EMBODIMENT

Figure 1A:
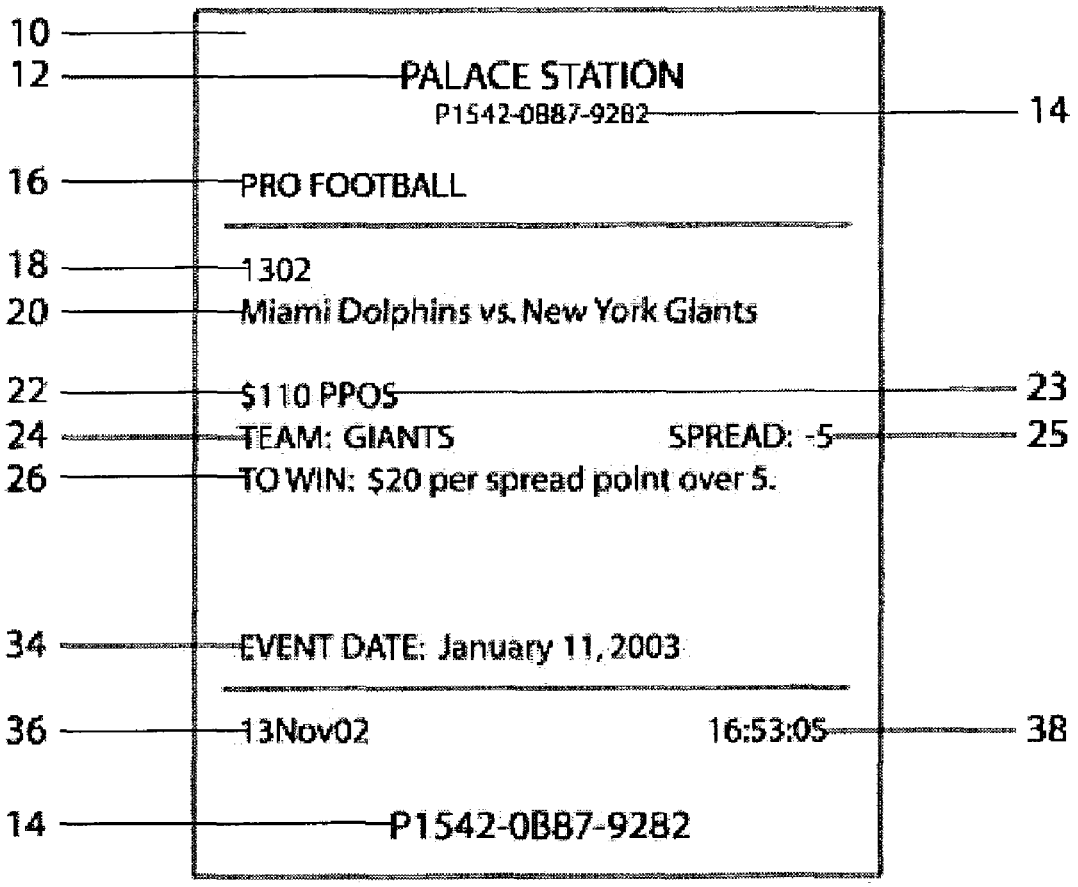
FIGS. 1*a* and 1*b* show examples of spread-line bets placed in accordance with the principles of the invention.

The preferred embodiments of the invention includes three types of Pay Per Point bets—spread-line, event-total-line, and team-total-line—that award pay outs based upon the difference between the actual and predicted results.

To place a Pay per Point bet, the bettor selects a sport, contestant, bet amount and bet type. All of the bet elements are recorded in the form of a Pay Per Point receipt ("ticket") as described below.

Common Features of Pay Per Point Bets

FIGS. 1*a* and 1*b*, 2*a* and 2*b*, and 3*a* and 3*b* show the features common of Pay Per Point bet tickets 10, as follows:

Name of House 12, "Palace Station." The name of the house 12 identifies the name of the house brokering the bet. Alternatively, Pay Per Point bets may be placed at any or all houses where the bet is legally offered, including: the same bet multiple times at the same house; the same bet multiple times with different house; different bets at the same house; different bets at different houses; or any other combination.

Bet Identification, 14 "P1542-Ob87-9282." The bet identification 14 identifies the particular bet using a unique reference number. Alternatively, Pay Per Point tickets 10 may use any method of bet identification 14, including: any combination of alpha-numeric code, bar code, color code, holography, or any other ticket identification.

Sport Category 16, "Pro Football." The sports category 16 identifies the type of sport(s) involved in the bet. Alternatively, Pay Per Point bets may be placed on any professional or collegiate sporting event that is legal to bet upon, including: baseball, basketball, golf, tennis, ice hockey, horse racing, soccer, or any other sports contest.

Sports Event Identification 18, "1302." The sport event identification 18 identifies the particular sports event using a unique reference number. Alternatively, Pay Per Point tickets 10 may use any method of sports event identification 18, including: any combination of alpha-numeric code, bar code, color code, holography, or any other sports event identification.

Names of Contestants 20, "Miami Dolphins vs. New York Giants." The name of the contestants 20 identifies some or all of the contestants involved in the bet. Alternatively, Pay Per Point tickets 10 may use any method for displaying the names of the contestants 20, including: full names, abbreviations, images, graphics, logos, or any other contestant identification.

Amount of Bet 22, "$110." The amount of the bet 22 identifies the exact amount bet upon the selected contestant(s). Alternatively, Pay Per Point tickets 10 may use any method to display the amount of bet 22, including: alpha-numeric characters (including decimals, fractions, and other non-whole number expressions), bar code, color code, or any other bet amount identification. In addition, Pay Per Point bets may be placed for any amount of money, in any currency.

Event Date 34, "Jan. 11, 2003." The event date 34 identifies the scheduled contest date. Alternatively, Pay Per Point tickets 10 may use any method for displaying the event date 34, including: full date, abbreviation, alpha-numeric code, bar code, color code, or any other date identification.

Date of Bet 36, "13Nov02." The date of the bet 36 identifies the exact date that the bettor placed the bet. Alternatively, Pay Per Point tickets 10 may use any method for displaying the date of bet 36, including: full date, abbreviation, alpha-numeric code, bar code, color code, or any other date identification.

Time of Bet 38, "16:53:05." The time of the bet 38 identifies the exact time that the bettor placed the bet. Alternatively, Pay Per Point tickets 10 may use any method for displaying the time of bet 38, including: military format, AM/PM format, alpha-numeric code, bar code, color code, or any other time identification. In addition, the time may be displayed as local time, GMT, or in reference to any other time standard.

In addition to the common features described above, Pay Per Point tickets 10 may also include other features, such as electronic funds transfer, additional validation methods, or any other information required by the house, bettor, or regulatory agency.

Unique Features of Pay Per Point Bets

Figure 1B:
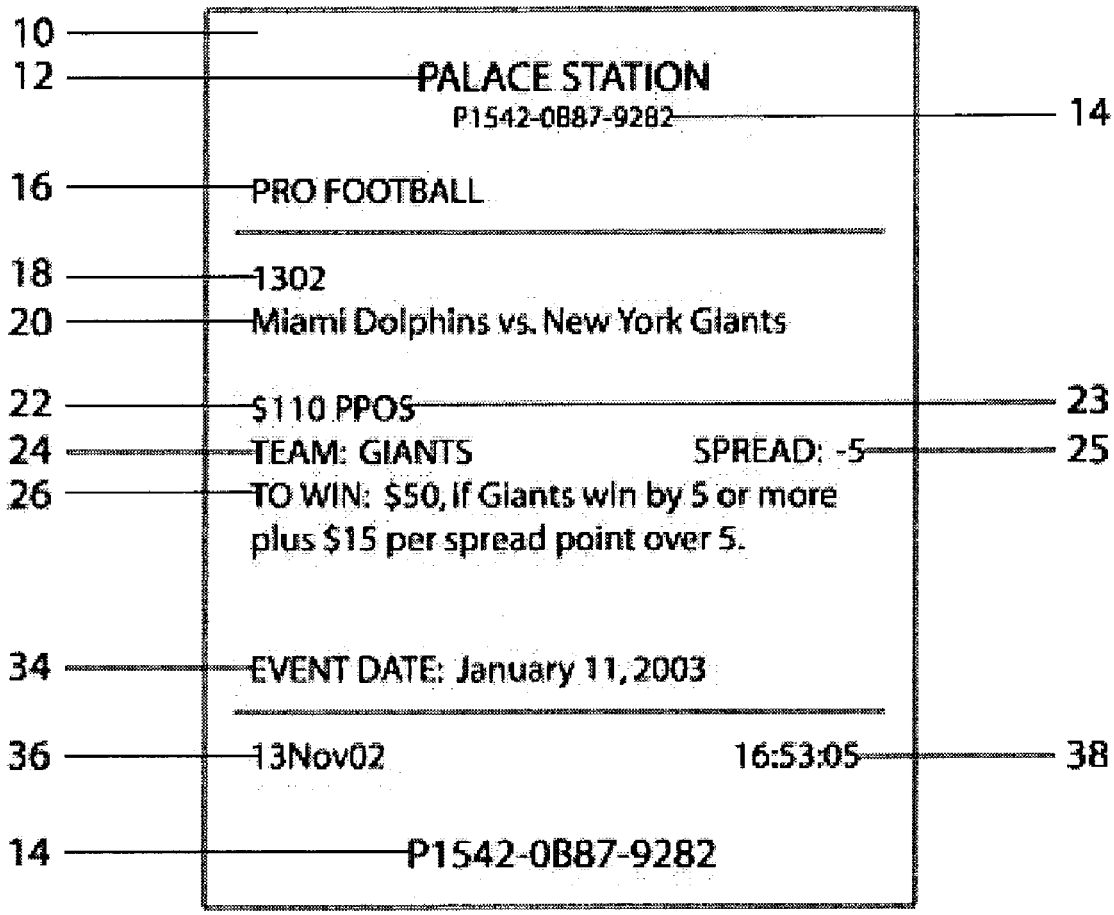

In addition to the common features described above, FIGS. 1*a* and 1*b*, 2*a* and 2*b*, 3*a* and 3*b* also show the unique features that distinguish each of the Pay Per Point tickets 10 from each other, as follows:

Spread-Line Bet. FIGS. 1*a* and 1*b* show Pay Per Point tickets 10 with the following unique features:

Type of Bet 23, "PPOS" (Pay per Point Over Spread). The type of the bet 23 identifies the spread-line bet method by which the wager will award payouts. Alternatively, Pay Per Point tickets 10 may display the type of bet 23, using: full name, abbreviation, alpha-numeric code, bar code, color code, or any other bet type identification.

Spread-line 25, "−5." The spread-line 25 identifies how much the favorite must win by; or, how much the underdog may lose by. Alternatively, Pay Per Point tickets 10 may use any method to display the spread-line 25, including: alpha-numeric characters (including decimals, fractions, and other non-whole number expressions), bar code, color code, or any other spread-line identification.

Spread-line bets may be set to any spread-line 25, at any point in time, with adjustments made for changed circumstances (i.e. injuries, location, weather, timing, etc.), balancing the books, or as otherwise required by the house or regulatory agency.

Team 24, "Giants." The team 24 identifies the selected contestant(s). Alternatively, Pay Per Point tickets may use any method for displaying the name of the team 24, including: full name, abbreviation, image, graphic, logo, or any other contestant identification.

Spread-line bets only allow the bettor to wager on a team 24 to cover the spread-line 25. The bettor may not bet that a team 24 will not cover the spread-line 25. To bet against a contestant, the bettor must make a spread-line bet 23 on the opposing contestant.

To Win 26, FIG. 1*a* "$20 per spread-line point over 5" and FIG. 1*b* "$50, if Giants win by 5 or more plus $15 per over-spread-line point" (also called pay schedule). The pay schedules 26 identify the amount awarded for each point of difference between actual and predicted results. Alternatively, Pay Per Point tickets 10 may use any method to display a pay schedule 26, including: alpha-numeric characters (including full descriptions, abbreviations, codes, etc.), color code, graphs, charts, or any other method of displaying a pay schedule.

The pay outs for Spread-line bets may be set to any pay schedule 26, at any time, with adjustments for: the average amount of each bet retained by the house ("hold"), the average amount of each bet returned to the bettor ("return"), the variance of the actual pay outs to the return ("volatility"), or as otherwise required by the house or regulatory agency.

Figure 2A:
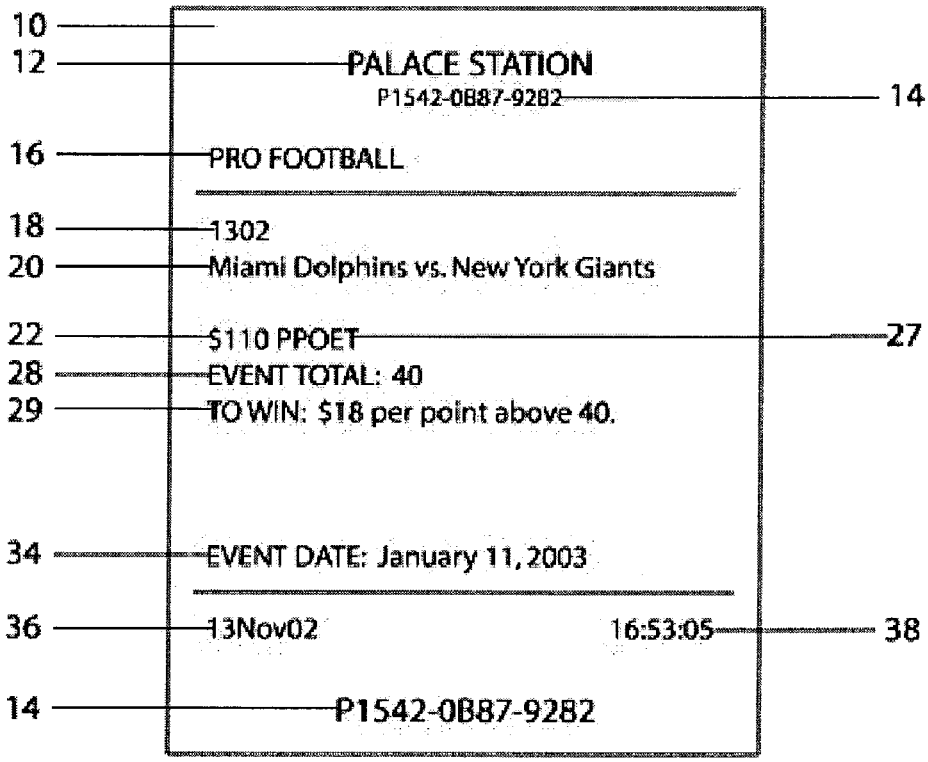
FIGS. 2*a* and 2*b* show examples of event-total-line bets placed in accordance with the principles of the invention.
Figure 2B:
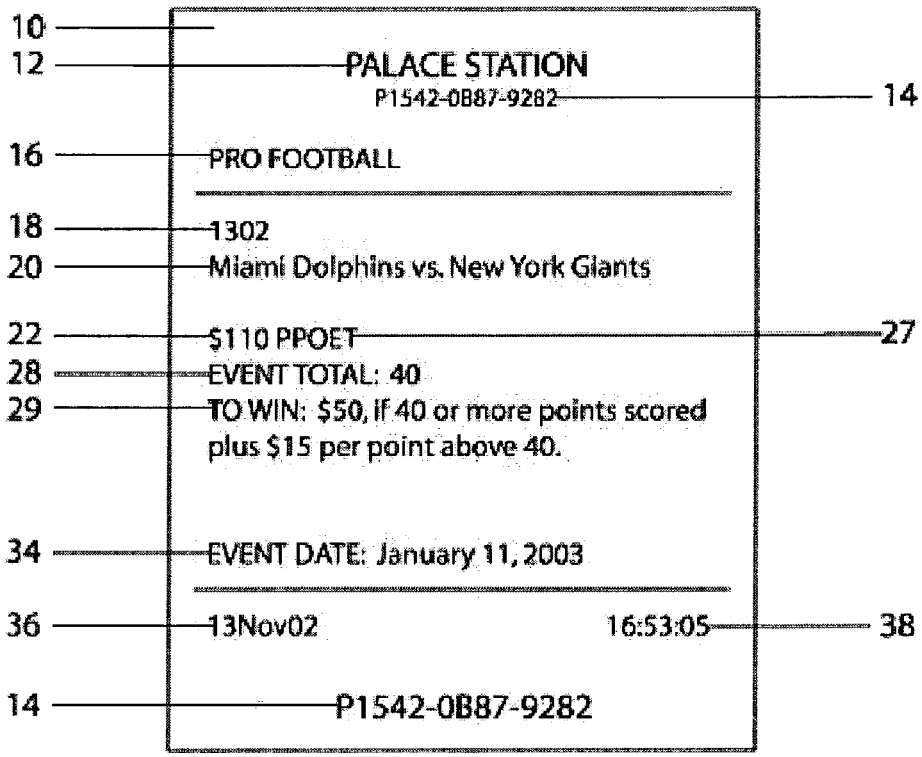

Event-Total-Line Bet. FIGS. 2*a* and 2*b* show Pay Per Point tickets 10 with the following unique features:

Type of Bet 27, "PPOET" (Pay per Point Over Event-Total-Line). The type of the bet 27 identifies the event-total-line bet method by which the wager will award payouts. Alternatively, Pay Per Point tickets 10 may use any method for displaying the type of bet 27, including: full name, abbreviation, alpha-numeric code, bar code, color code, or any other bet type identification.

Event-total-line bets allow the bettor to bet on whether the contestants 20 will score over or under the event-total-line 28. FIGS. 2*a* and 2*b* only show bets on PPOEL, or pay for points over the event-total-line 28. The type of bet 27, however, may also be set to "PPUET," or pay for points under event-total-line 28. (PPUET bets not shown in the figures.)

Event-Total-Line 28, "40." The event-total-line 28 identifies how many points the contestants 20 must score. (For under bets, the event-total-line 28 identifies how many points the contestants 20 must not score.) Alternatively, Pay Per Point tickets 10 may use any method to display the event-total-line 28, including: alpha-numeric characters (including decimals, fractions, and other non-whole number expressions), bar code, color code, or any other event-total-line identification.

Event-total-line Bets may be set to any event-total-line 28, at any time, with adjustments made for changed circumstances (i.e. injuries, location, weather, timing, etc.), balancing the books, or as otherwise required by the house or regulatory agency.

To Win 29, FIG. 2*a* "$18 per point over 40" and FIG. 2*b* "$50, if 40 or more points scored plus $15 per point above 40" (also called pay schedule). The pay schedules 29 identify the amount awarded for each point of difference between actual and predicted results. Alternatively, Pay Per Point tickets 10 may use any method to display a pay schedule 29, including: alpha-numeric characters (including full descriptions, abbreviations, codes, etc.), color code, graphs, charts, or any other method of displaying the pay schedule.

The pay outs for event-total-line bets may be set to any pay schedule 29, at any time, with adjustments for: hold, return, volatility, or as otherwise required by the house or regulatory agency.

Figure 3A:
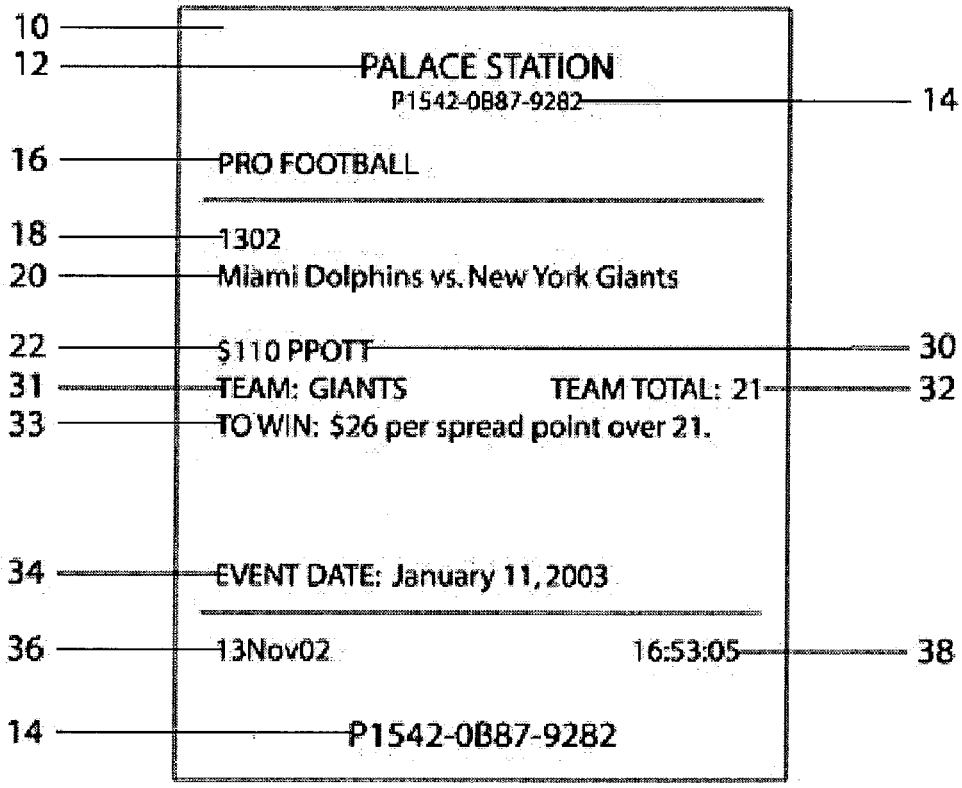
FIGS. 3*a* and 3*b* show examples of team total bets placed in accordance with the principles of the invention.
Figure 3B:
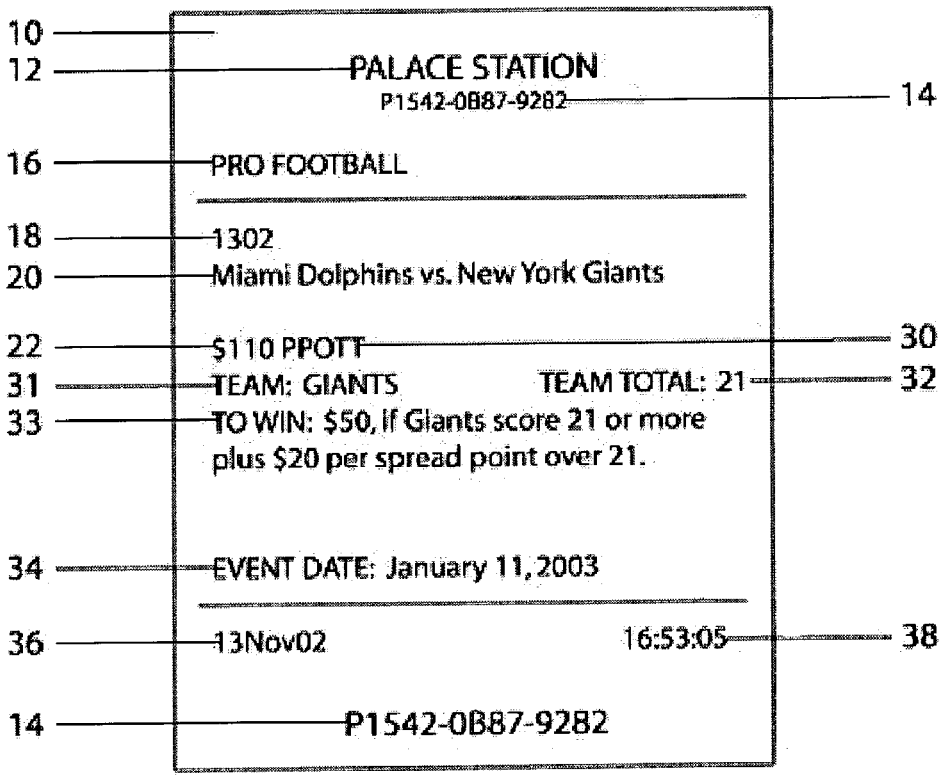

Team-Total-Line Bet. FIGS. 3*a* and 3*b* show Pay Per Point tickets 10 with the following unique features:

Type of Bet 30, "PPOTT" (Pay for Point Over Team-Total-Line). The type of the bet 30 identifies the team-total-line bet method by which the wager will award payouts. Alternatively, Pay Per Point tickets 10 may use any method for displaying the type of bet 30, including: full name, abbreviation, alpha-numeric code, bar code, color code, or any other bet type identification.

Team-total-line bets allow the bettor to bet on whether a particular team 31 will score over or under the team-total-line 32. FIGS. 3*a* and 3*b* only show bets on PPOTT, or pay for point over the team-total-line 32. The type of bet 30, however, may also be set to "PPUTT," or pay for point under team-total-line 32. (PPUTT bets not shown in the figures.)

Team 31, "Giants." The team 31 identifies the selected contestant. Alternatively, Pay Per Point tickets 10 may use any method for displaying the team 31, including:, full name, abbreviation, image, graphic, logo, or any other contestant identification.

Team-Total-Line 32, "21." The team-total-line 32 identifies how many points the team 31 must score. (For under bets, the team-total-line 32 identifies how many points the team 31 must not score.) Alternatively, Pay Per Point tickets 10 may use any method to display the team-total-line 32, including: alpha-numeric characters (including decimals, fractions, and other non-whole number expressions), bar code, color code, or any other spread-line identification.

Team-total-line bets may be set to any team-total-line 32, at any time, with adjustments made for changed circumstances (i.e. injuries, location, weather, timing, etc.), balancing the books, or as otherwise required by the house or regulatory agency.

To Win 33, FIG. 3*a* "$26 per point over 21" and FIG. 3*b* "$50, if 21 or more points scored plus $20 per point above 21" (also called pay schedule). The pay schedules 33 identify the amount awarded for each point of difference between actual and predicted results. Alternatively, Pay Per Point tickets 10 may use any method to display a pay schedule 33, including: alpha-numeric characters (including full descriptions, abbreviations, codes, etc.), color code, graphs, charts, or any other type of pay out indication.

The pay outs for team-total-line bets may be set to any pay schedule 33, at any time, with adjustments for: hold, return, volatility, or as otherwise required by the house or regulatory agency.

Pay Schedules for Pay Per Point Bets

FIGS. 1*a* and 1*b*, 2*a* and 2*b*, and 3*a* and 3*b* show the different types of pay schedules used for Pay Per Point tickets 10, as follows:

FIGS. 1*a*, 2*a* and 3*a* show pay schedules that pay a fixed sum for each point difference between the actual and predicted results. For example, FIG. 1*a* shows the pay schedule 26 set to "$20 per spread-line point over 5;" FIG. 2*a* shows pay schedule 29 set to "$18 per point above 40;" and FIG. 3*a* shows pay schedule 33 set to "$26 per point over 21."

FIGS. 1*b*, 2*b* and 3*b* show pay schedules that pay a fixed sum for attaining the exact spread-line, event-total-line, or team-total-line, plus another sum for each point difference between the actual and predicted result. For example, FIG. 1*b* shows the pay schedule 26 set to "$50, if Giants win by 5 or more plus $15 per over-spread-line point;" FIG. 2*b* shows pay schedule 29 set to "$50, if 40 or more points scored plus $15 per point above 40;" and FIG. 3*b* shows pay schedule 33 set to "$50, if Giants score 21 or more points plus $20 per point over 21."

All Pay Per Point pay schedules, including those shown in FIGS. 1*a*, 1*b*, 2*a*, 2*b*, 3*a* and 3*b*, are calculated using statistical modeling. A statistical model for any sport can be built using the actual and predicted results from a statistically significant number of prior contests. A "significant sample" is defined as a sample with interval of confidence of 99% that the average return is within this range and a margin of error of less than 0.5 of 1%, or 0.005. For example, the model for professional football uses spread-lines, event-total-lines, and team-total-lines from a significant sample of 3,152 prior contests.

Once built, the statistical model determines the number of pay schedules necessary for each type of bet in a sport and then calculates the hold, return and confidence interval for that pay schedule, as follows:

Number of Pay Schedules. The most favorable outcome of statistical modeling of a sport will show that one pay schedule can cover any possible scenario within a bet type. For example, a team-total-line bet with any team-total-line pays $20 for each point over or under the team-total-line. A less favorable outcome will show that multiple pay schedules must be used within a bet type. For example, a team-total-line bet with any team-total-line pays $12 for points scored under the total and $16 for points scored over the total. The least favorable outcome will show that different pay schedules must be used for each scenario within a bet type. For example, a team-total-line bet with a team-total-line set at 21 pays $20 for each point over the total and $24 for each point under the total, but a team-total-line set at 32 pays $17 for each point over the total and $15 for each point under the total.

To determine the number of pay schedules required for each bet type, two variables must be considered: 1) The line "L", be it either spread-line, event-total-line, or team-total-line, and 2) the difference "D" between the actual result and the line. Only one pay schedule will cover all scenarios within a bet type if the statistical modeling shows that as the value of "L" varies from its lowest value to its highest, the range and distribution of values for "D" remain the same. That is, given any two values for L, say $L_1$ and $L_2$, and given that there are $n_1$ and $n_2$ associated historical events in our statistical sample:

1) the averages can be expressed as: $\text{sum}[D_1(L_1)+ \ldots + Dn_1(L_1)]/n_1 \sim = \text{sum}[D_1(L_2)+ \ldots + Dn_2(L_2)/n_2$;and 2) the standard deviations can be expressed as: $\text{StdDev}[D_1(L_1), \ldots, Dn_1(L_1)] \sim = \text{StdDev}[D_1(L_2), \ldots, Dn_2(L_2)$ Fortunately, the results of the sports analyzed to date exhibit this preferred behavior and, therefore, only require one pay schedule. Note that "one pay schedule," however, does not mean that exactly one pay schedule must cover all scenarios with in a bet type. Each of many pay schedules may work unto themselves, with the choice of pay schedule left to the bettor, house or regulatory agency. For example, in FIG. 1*a*, the house offers $20 per point over spread-line 25 and, in FIG. 1*b*, the house offers $50 for making the spread-line 25 and $15 for each point over the spread-line 25. Either pay schedule will cover all spread-line bet scenarios, with the choice of pay schedule left to the bettor.

In the event that statistical models of other sports produce results that cannot support single pay schedules, multiple pay schedules must be used to account for any statistical variations within the bet type.

Hold, Return, and Volatility. The pay schedule determines the hold, return and volatility of the wager. A pay schedule that will allow the house to retain 8% of each dollar wagered, on average, has an 8% hold and a 92% return. A pay schedule that results in small losses and wins, on average, has a "low" volatility; a bet with big losses and wins, on average, has a "high" volatility.

For any pay schedule, the hold, return, and volatility are calculated by plugging the desired pay outs into every contest in the statistical model. For each type of bet-spread-line, event-total-line and team-total-line—the return is calculated by summing the pay outs on all games and dividing by the number of games; the hold is then calculated by subtracting the return from 1; and the volatility is calculated by using the standard deviation.[1]

For example, a pay schedule of $26 per point over the team-total-line for all 3,152 professional football games in the model results with an average return of $212.74, or a 92% average return and an 8% hold. In addition, the model shows, with certainty of 95%, that the average return will fall within the range from $208.40 to $216.58 and, therefore, produces a volatility range of 89.91% to 96.89%.

The team-total-line bet is a new type of bet and, therefore, no team-total-lines have been set or recorded in any sport. Team-total-lines for the favorite (f) and underdog (u), however, can be mathematically derived by using historical spread-line (s) and the event-total-line (et) data, as follows: a) f=u+s b) et f+u Using a) to substitute for f in b) yields . . . c) et=2u+s or u=(et−s)/2 Plugging in c) into a) yields . . . d) f=(et+s)/2

The house favors pay schedules with high holds/low returns and the bettor favors pay schedules with low holds/high returns. The choice of volatility, however, depends on the preference of the house and/or bettors. The volatility will not affect the ultimate hold or return, however, it will affect the "ups" and "downs" experienced by the bettor. For example, two pay schedules with similar holds and returns but different volatilities may result in different pay out amounts for the same contest:

Using the pay schedules 26 of FIGS. 1*a* and 1*b*, the Giants win by 25 points: 1A) the Pay Per Point ticket 10 in FIG. 1*a* pays $400, or, $0 for the first 5 spread-line points and $20 for each of the 20 spread-line points over 5; 1B) the Pay Per Point ticket 10 in FIG. 1*b* pays $350, or, $50 for the first 5 spread-line points and $15 for each of the 20 spread-line points over 5.

Using the same pay schedules 26 of FIGS. 1*a* and 1*b*, the Giants win by 6 points: 1A) the Pay Per Point ticket 10 in FIG. 1*a* pays $20, or, $0 for the first 5 spread-line points and $20 for the single spread-line point over 5; 1B) the Pay Per Point ticket 10 in FIG. 1*b* pays $65, or, $50 for the first 5 spread-line points and $15 for the single spread-line point over 5. Thus, the higher pay out generated by pay schedule 26 in FIG. 1A demonstrates higher volatility than the pay schedule 26 of FIG. 1B.

Thus, the higher and lower pay outs generated by pay schedule 26 in FIG. 1A demonstrates greater volatility than the more even and steady pay schedule 26 of FIG. 1B. The choices of volatility, hold, or return for a pay schedule may be adjusted as required by the house or regulatory agency.

PREAMBLE TO THE CLAIMS

The many features and advantages of the invention are apparent from the description and illustration of the preferred embodiments above. The invention, however, is not limited to these embodiments, as the invention is capable of other embodiments and of being practiced and carried out in various ways. For example, features incorporated in of one embodiment may be used in other embodiments to yield another embodiment. Additionally, features mentioned in any embodiment may be interchanged with similar features not mentioned that perform the same or similar functions. And, finally, the phraseology and terminology used to explain the embodiments are only descriptive and should not be regarded as limiting. The claims, therefore, seek to cover all features and advantages of the invention which fall within the true spirit and scope of the invention.

What is claimed is:

1. A method of operating a sporting event wagering establishment comprising:

a) predicting the results of sporting event that can be quantified by numeric values;

b) accepting wagers from bettors upon the results of said sporting event, with each wager placed upon predicted results of the sporting event;

c) issuing awards for winning wagers according to a predetermined payout schedule dependent upon the discrepancy between the predicted results of the sporting event and the actual results of the sporting event; and d) keeping losing wagers without exposing the bettors to any additional loses above and beyond the original wagers, regardless of the discrepancy between the predicted results of the sporting event and the actual results of the sporting event.

2. A method of operating a sporting event wagering establishment comprising:

a) predicting the results of a sporting event that can be quantified by numeric values;

b) accepting wagers from bettors upon the results of said sporting event, with each wager placed upon predicted results of the sporting event;

c) using one or more pay schedules with awards based upon the discrepancy between the predicted results of the sporting event and the actual results of the sporting event;

d) issuing awards for winning wagers based upon the pay schedule(s); and e) keeping losing wagers without exposing the bettors to any additional loses above and beyond the original wagers, regardless of the discrepancy between the predicted results of the sporting event and the actual results of the sporting event.

3. A method of operating a sporting event wagering establishment comprising:

a) predicting the results of sporting event that can be quantified by numeric values;

b) accepting wagers from bettors upon the results of said event, with each wager placed upon the predicted results of the sporting event;

c) using one or more pay schedules with awards based upon the discrepancy between the predicted results of the outcome and the actual results of the sporting event, with the number of pay schedules determined as follows:

(1) establish a data set of prior sporting events including the predicted and actual results of said prior sporting events;

(a) let "L" represent the predicted result;

(b) let "D" represent the discrepancy between the predicted and actual results;

(2) measure D as L varies from its lowest value to its highest value across all prior events;

(a) use one pay schedule if D remains within 1 or more standard deviations from L, as L varies from its lowest value to its highest value; or (b) use more than one pay schedule if D does not remain within 1 or more standard deviations from L, as the value of L varies from its lowest value to its highest value, with a different pay schedule for each range of L values for which D remains within 1 or more standard deviations from L;

d) issuing awards for winning wagers based upon the pay schedule(s);

e) keeping losing wagers without exposing the bettors to any additional loses above and beyond the original wagers, regardless of the discrepancy between the predicted results of sporting event and the actual results of the sporting event.

4. A method of operating a sporting event wagering establishment comprising:

a) predicting the results of sporting event that can be quantified by numeric values;

b) accepting wagers from bettors upon the results of said sporting event, with each wager placed upon the predicted results of the sporting event;

c) using one or more pay schedules with awards based upon the discrepancy between the predicted results of the sporting event and the actual results of the sporting event, with the number of pay schedules determined as follows:

(1) establish a data set of prior events including the predicted and actual results of said prior events;

(a) let "L" represent the predicted result;

(b) let "D" represent the discrepancy between the predicted and actual results;

(2) measure D as L varies from its lowest value to its highest across all prior events;

(a) calculate the average D value for each L value, as represented by the following equations using any two values for L, say $L_1$ and $L_2$, and given that there are $n_1$ and $n_2$ events in the data set: sum[$D_1(L_1)$+ . . . +$Dn_1(L_1)$]/$n_1$~=sum [$D_1(L_2)$+ . . . + $Dn_2(L_2)$/$n_2$; and (b) calculate the standard deviation of D from L, as expressed by the following equations using any two values for L, say $L_1$ and $L_2$, and given that there are $n_1$ and $n_2$ events in the data set:: stdDev [$D_1(L_1)$, . . . ,$Dn_1(L_1)$]~=StdDev[$D_1(L_2)$, . . . , $Dn_2(L_2)$);

(3) use one pay schedule if D remains within 1 or more standard deviations from L, as L varies from its lowest value to its highest value; or (4) use more than one pay schedule if D does not remain within 1 or more standard deviations from L, as the value of L varies from its lowest value to its highest value, with a different pay schedule for each range of L values for which D remains within 1 or more standard deviations from L;

d) issuing awards for winning wagers based upon the pay schedule(s);

e) keeping losing wagers without exposing the bettors to any additional loses above and beyond the original wagers, regardless of the discrepancy between the predicted results of the sporting event and the actual results of the sporting event.

* * * * *